United States Patent [19]

Warehime

[11] Patent Number: 4,930,645

[45] Date of Patent: Jun. 5, 1990

[54] TETHERED PAIR LIQUID FEEDER/TOY SET

[76] Inventor: Norwood R. Warehime, 2021 Schuster Rd., Jarrettsville, Md. 21084

[21] Appl. No.: 422,745

[22] Filed: Oct. 17, 1989

[51] Int. Cl.[5] ..... A61J 9/00; B65D 23/12

[52] U.S. Cl. ..... 215/11.1; 215/100 R; 220/23.83; 220/23.86; 446/75; 446/77; 446/227

[58] Field of Search ..... 220/23.4, 375, 23.83, 220/23.86; 215/1 R, 6, 10, 11.1, 11.3–11.6, 100 R; 273/58 C; 224/148; 446/71, 75–77, 227; 128/359, 360; 606/234–236

[56] References Cited

U.S. PATENT DOCUMENTS

| | | | |
|---|---|---|---|
| 78,881 | 6/1868 | Libbey | 215/11.1 |
| 2,014,236 | 9/1935 | McNamara | 215/11.1 X |
| 2,699,785 | 1/1955 | Allen | 606/236 |
| 2,926,805 | 3/1960 | Mead | 215/11.1 |
| 2,949,203 | 8/1960 | Berg | 215/6 |
| 2,975,547 | 3/1961 | Greve | 446/77 |
| 2,994,448 | 8/1961 | Sepe et al. | 215/1 R |
| 3,051,341 | 8/1962 | Mead | 215/11.1 |
| 3,085,610 | 4/1963 | Vardan | 446/227 X |
| 3,099,452 | 7/1963 | Fernicola | 446/76 X |
| 3,112,837 | 12/1963 | Manoyian | 215/11.1 |
| 3,258,873 | 7/1966 | Franco | 215/11.1 X |
| 3,394,018 | 7/1968 | Velonis et al. | 215/11.1 X |
| 3,512,301 | 5/1970 | Kramer | 446/71 |
| 4,249,333 | 2/1981 | Chase et al. | 606/235 X |
| 4,346,902 | 8/1982 | Warehime | 273/58 C X |
| 4,498,613 | 2/1985 | Donahue et al. | 224/148 X |
| 4,603,784 | 8/1986 | Chang | 215/11.1 |
| 4,778,068 | 10/1988 | Kohus | 215/11.1 |
| 4,850,496 | 7/1989 | Rudell et al. | 215/11.1 X |
| 4,856,647 | 8/1989 | Dahne | 220/23.4 X |

FOREIGN PATENT DOCUMENTS

| | | | |
|---|---|---|---|
| 230362 | 7/1987 | European Pat. Off. | 215/11.1 |
| 567847 | 3/1945 | United Kingdom | 446/227 |

OTHER PUBLICATIONS

"Daddy's Turn", From pg. 2 of Baltimore Sun, Saturday, 10/7/89, Baltimore, Md.

"Double-Trouble Balls", Brochure from I-I Sports, Jarrettsville, Md., 21084.

*Primary Examiner*—Sue A. Weaver

[57] ABSTRACT

The invention relates to a method of making tethered pair liquid feeder/toy sets for infant use. Spherical shaped containers with segmental spherical seal rings are connected by a tether line long enough to space feeding nipples of containers about same as that of average mother's breasts. Interchangeable nipple substitutes are used are used to convert liquid containers to play ball sets and toys. Invention also shows how conventional elongated liquid containers can be converted to tethered pair containers by attachment of tether line to conventional seal rings, and by use of free tether line assemblage with thin flat washer-like rings that can be placed under seal rings. A wide variety of toy items can be placed inside containers and on tops of closure caps for containers, with toy items having visual, audible, and mechanically actuated features.

16 Claims, 1 Drawing Sheet

TETHERED PAIR LIQUID FEEDER/TOY SET

BACKGROUND OF THE INVENTION

1. Field of the Invention

The invention relates to infant liquid feeders, and particularly to feeders that are connected with a line to form a paired tether set. Also, the invention relates to how such tethered sets can be converted to play toys suitable for infant use. One major aspect of the invention is the use of spherical liquid feeder containers which can be converted to a tethered pair of play balls. The tether line for paired feeders has a length that will space liquid filled containers about the same as that of a mother's breasts when tether line is taut.

2. Description of the Related Art

Prior art revealed no direct design as that of subject invention. U.S. Pat. No. 4,346,902 to Warehime, the same person presenting subject invention, has paired tethered ball set with ball spacing from 10" to 20" (25 to 50 cm), with ball diameters ranging from 1⅝" to 2⅞" (4.2 to 7.4 cm). The prior art ball sets are intended for use by persons over 6 years and did not have any feeder aspects. But it was noted by the inventor that when a ball set was given to an infant, the infant would grasp the balls firmly and usually put one ball to its mouth, suggesting the basic instinct of breast feeding. Another prior art reference is a newspaper article in The Baltimore Sun, page 2, Oct. 7, 1989 (Baltimore, Md., USA), which shows and describes how a pair of breast-feeding bottles are placed in a brassiere-like harness so a father can wear and "breast-feed" an infant. No play/-toy aspects are present in this design. Conventional elongated feeding bottles are used singularly and have no obvious play/toy aspects. Also, such bottles can easily slide or fall from area of infant use. Furthermore, such bottles have no suggestion of the mother's breasts. Tethered pair feeders of subject invention offers many features that are lacking in the prior art, in that they do suggest the mother's breasts and will encourage feeding; they can be converted easily to play toys, or one container can be used for feeding and the other for play; tether pair containers tend to stay in place better than conventional containers since one container holds the other back; tethered pair containers can be hung conveniently on frame of crib, carriage or hook. Also, they can help to develop ambidexterity of the infant when it handles the two containers at one time.

SUMMARY OF THE INVENTION

Subject invention deals directly with infant feeder containers that are connected by a line to form tethered pair feeder sets that can be converted easily to play toys for infants. Spherical containers with segmental spherical shaped sealing rings are used to simulate the mother's breasts. To keep the spherical appearance, the seal rings which hold the feeding nipples in place have access holes which allow the seal rings to be screwed on and off when necessary by using a donut-like key that has prongs to fit into the access holes of the seal rings. Also, the containers have small access holes for receiving the ends of the tether line. Standard feeding nipples are used on containers. Interchangeable items that fit on containers in place of nipples have same size sealing flanges and matching dimensions where needed in container opening area. Closure caps and closure caps with attached toys can be fitted on containers when so desired. The spherical containers are easy to clean and should be made of transparent material to retain full visual effect of toys that may inserted into containers. The tether line is short and can be strung with beads or sleeves for added play effect and as a safety measure. With closure caps having segmental spherical outside surfaces used in place of nipples, the overall containers have shapes of spheres or a tethered pair of play bills. Furthermore, play/toy items can also be placed inside of containers for added visual and audible effects. Closure caps can also have added mechanical attachments that can be actuated by infant. The invention also shows how conventional elongated containers can be connected with tether lines so as to make it possible to extend their use aspects further as tethered pair feeders. This can be done by providing nipple seal rings with attachment means to connect tether line. Also, another method of attachment can be accomplished by using a special tether line arrangement which has thin, flat rings that are passed through seal ring openings and then placed on tops of nipple or closure cap flanges and then seal rings are rotated to tighten the assemblies. Another arrangement is a tether line with elastic end loops which are stretched and placed around necks of the containers. Referring to the drawings:

DESCRIPTION OF THE PREFERRED EMBODIMENTS

Figure 1:
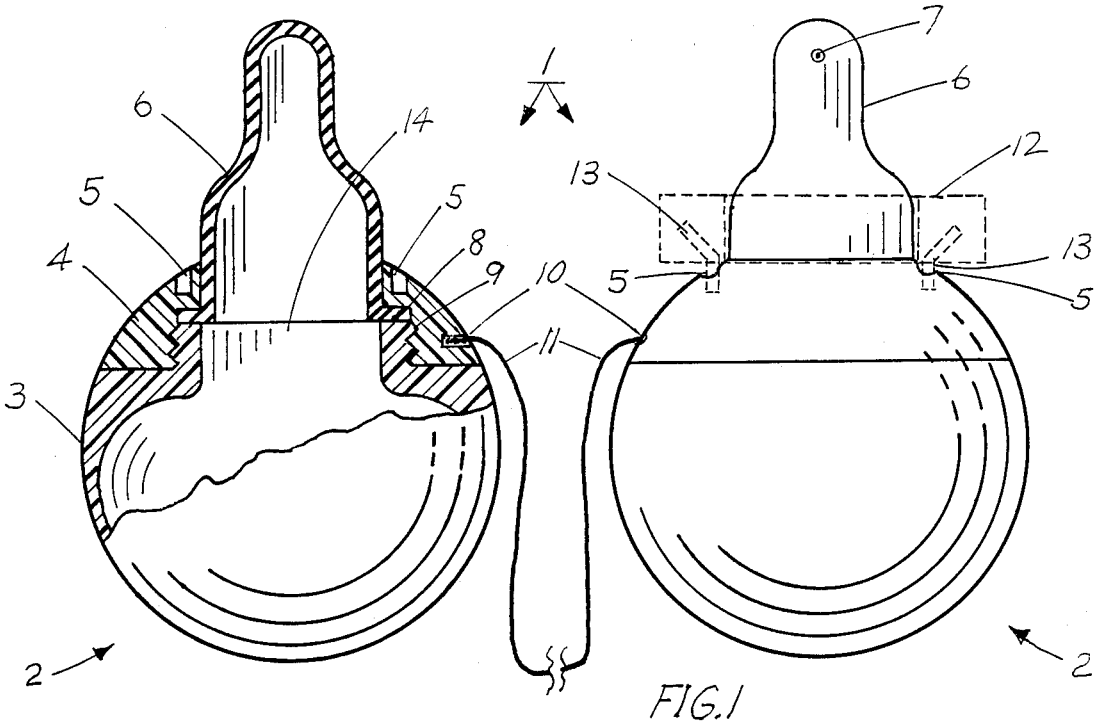
FIG. 1 is a side elevation of a tethered pair of spherical infant feeders or containers, with one container having a cut portion showing seal ring, container, and nipple details, with other container showing how pronged seal ring key, in phantom view, is used to rotate seal ring.

FIG. 1 shows a general view of tethered pair of spherical liquid feeder containers 1, made up of two unit containers 2, with each having the same basic features and elements such as spherical bulb 3 with threaded nozzle on outside wall, threaded seal ring 4, seal ring access holes 5 to facilitate placement of a donut-shaped seal ring key 12, shown in phantom view, having projecting prongs 13 that can be placed into access holes 5 for rotation of seal ring 4. Conventional liquid feeding nipple 6 is clamped in place by having its pliable flange 8 squeezed between the inner shoulder of container bulb 3 and the inner shoulder of seal ring 4 with screw action taking place by mating threads 9 when seal ring 4 is rotated in closing direction. Nipple feeder hole 7 is outlet of nipple. Hole 10 in seal ring is for receiving and attachment of tether line 11 which connects both container units 2. The diameter of a spherical container is about 2¾" (7 cm) and container will hold about 4.0 oz.

(124 cc) of liquid. The tether line is fashioned in length to have spacing of centers of containers approximate that of the average mother's breasts spacing when tether line is taut. This should make length of tether line about 6" to 7" (15.3 to 17.8 cm) between containers. For safety reasons and for added attraction for infant, beads and/or sleeves can be strung on line. The seal ring key 12 could in other forms so long as the projecting prongs 13 can be placed easily into the access holes 5 on seal ring 4. Several wrench type keys could be used. Receiving hole 10 in seal ring 4 could also be placed in container bulb 3, just under the outer shoulder where the wall material is fairly thick. The container bulb 3 and seal ring 4 should be made of transparent material to provide better visual effect of play toys inside container when that option is taken. Also, better cleaning of bulb is possible. Spherical container bulb 3 has large nozzle opening 14 which allows easy cleaning access to inside container.

Figure 2:
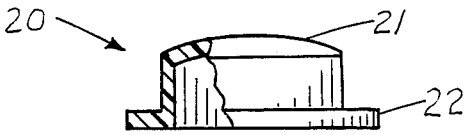
FIG. 2 is a side elevation of a closure cap, with cut portion showing interior.

FIG. 2 shows an optional feeder/toy fixture in form of a container closure cap 20, with segmental spherical top surface 21, and flange 22 which is same size of nipple flange 8 in FIG. 1. Cap 20 should be made of rigid material and sized so top surface 21 will be flush with that of seal ring 4 and should form a smooth spherical surface in the general area.

Figure 3:
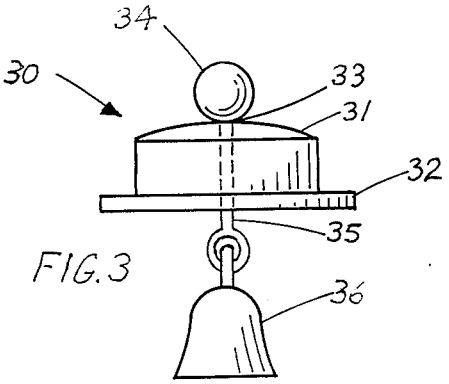
FIG. 3 is a side elevation of a closure cap with attached toy (bell) with actuating knob.

FIG. 3 shows an assemblage of closure cap with toy attached 30, with main elements consisting of segmental spherical surface 31, flange 32, rod passage hole 33, twirling knob 34, hanging rod 35, and bell 36. Assemblage 30 can be used in place of nipple 6 or closure cap 20. Many types of toy items can be added to closure cap.

Figure 4:
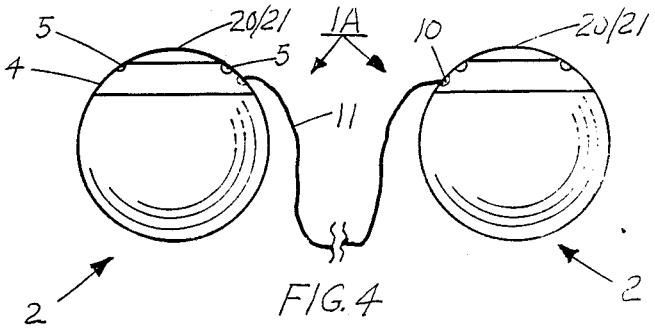
FIG. 4 is a side elevation of a tethered pair of spherical containers in reduced scale, with closure caps in place, forming tethered ball set.

FIG. 4 shows how a tethered pair of spherical containers 1A appears when converted to a pair of play balls, with each unit container 2 having a closure cap 20 in place of a feeding nipple 6. Segmental spherical surface 21 of closure cap 20 blends with spherical surfaces of container bulb 3 and seal ring 4 to form a reasonable spherical container or ball.

Figure 5:
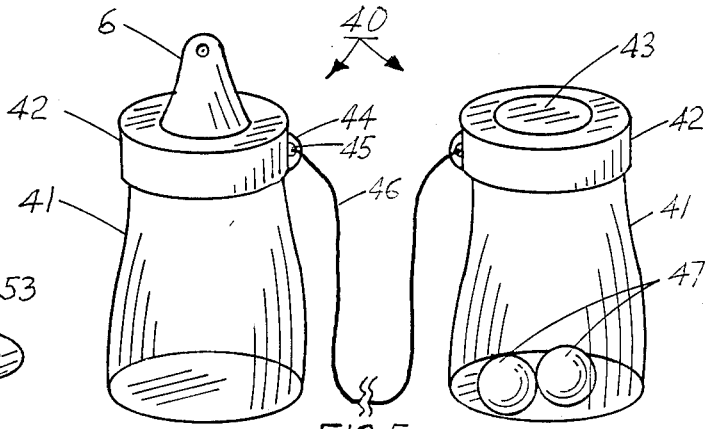
FIG. 5 is a reduced scale perspective of a tethered pair of conventional elongated containers with closure cap on a container and with toy objects inside same container.

FIG. 5 shows a tethered pair of conventional elongated feeding containers 40 made up of conventional containers 41 and seal rings 42, with one container unit having standard nipple 6 and the other having a closure cap 43. Each seal ring 42 has a boss 44 with eyelet 45 for attachment of tether line 46. Play objects 47 are placed inside the container that has closure cap 43 for added toy effect. A wide variety of toy objects can be added in this manner. Also, toys that can be actuated by infant can be used, such as that shown in FIG. 3. Tether attachment boss 44 and eyelet 45 on seal ring 41 could be replaced by adhesively attached pad with perforated tab to receive tether line.

Figure 6:
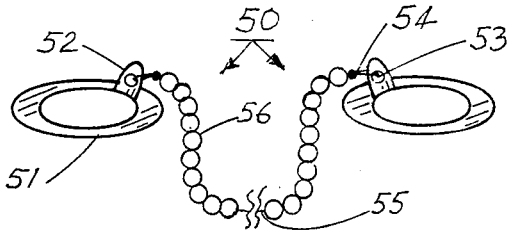
FIG. 6 is a reduced scale perspective of a tether line assemblage that can be used to form a tethered pair of conventional elongated containers.

FIG. 6 is a tether line assemblage 50 that can be used to form a tethered pair liquid feeder set using conventional elongated containers and their seal rings without any modifications. Assemblage 50 consists of two units, with each unit being a thin flat pliable washer-like ring 51, with small tab 52 and with aperture opening 53 therein. The two units are connected together by tie fasteners 54 and ends of tether line 55. Optional beads 56 can be strung on line 55 as added play item and as safety precaution against possible cutting effect of line. Length of line should be about 6" to 7" (15.3 to 17.8 cm) long between seal rings. In attaching tether line assemblage 50 to containers, the washer-like ring 51 is first folded slightly and passed through the top opening of a free seal ring similar to that shown in FIG. 5. Next, a nipple 6 or closure cap 43 is placed on top shoulder of elongated container 41 and the washer-like ring 51 is placed on top of the flange of nipple 6 or closure cap 43. Ring 51 is sized with same outer diameter as nipple 6 or closure cap 43. With all items in proper position, seal ring is then turned to clamp all items together, with tab 52 passing up through seal ring opening along side nipple 6 or at edge of closure cap 43, depending on which item is used. Same treatment is done on each container. Use of containers of 4 oz. (125 cc) volume is suggested for this type of tethered pair containers. This tether line assemblage provides a simple and inexpensive method of making a tethered pair liquid feeder/toy set for infant use.

Although particular embodiments of the invention have been illustrated in the accompanying drawings and discussed in the foregoing description, it is understood that the invention is not limited to the embodiment disclosed, but is intended to embrace any alternatives, modifications, and rearrangements and/or substitutions of parts, elements, and formats that may fall within the spirit and scope of the invention.

What is claimed is:

1. Tethered pair liquid feeder/toy set, normally for infant use, comprising:

a pair of containers, constructed for holding liquids, with each of said containers having general spherical form and a short outwardly projecting nozzle opening including threads on the outer wall side of said nozzle opening, with abutting shoulders on both sides of said nozzle opening threads, with said nozzle opening threads and said shoulders defining cooperating means to facilitate the placement of a rotatable nozzle ring with general segmented spherical shape and threads to mate with said each of said containers and with abutting shoulders on both sides of said nozzle ring threads, with said cooperating means also including mating of said shoulders of said nozzle opening and said nozzle ring to clamp and hold the matching flanges of interchangeable feeder/toy fixtures placed within the said nozzle opening of said nozzle ring, with said nozzle ring having means to permit rotation of said nozzle ring, with the general combination of said container and said nozzle ring having at least one means for receiving and making a tether line attachment;

a length of tether line suitable for linking said pair of containers;

two of a number of interchangeable feeder/toy fixtures including infant feeding nipples, container closure caps, and container closure cans with attached toys, with all of said fixtures having flanges and sizes suitable for attachment to and functional use on said containers in said nozzle opening;

whereby two of said separate unit container assemblies as described above can be connected by said tether line, linked and held fixed to said attachment means of said general combination of said container and said nozzle ring, and thereby forming said tethered pair liquid feeder/toy set.

2. Tethered pair liquid feeder/toy set as in claim 1, wherein said means to permit rotation of said nozzle ring comprises two small holes in said nozzle ring into which mating prongs of a separate ring-like key can be inserted to rotate said nozzle ring for clamping onto and releasing said flanges of interchangeable feeder/toy fixtures.

3. Tethered pair liquid feeder/toy set as in claim 1, wherein said means to permit rotation of said nozzle ring comprises two slightly notched areas on said nozzle ring which facilitates rotation of said nozzle ring with fingers.

4. Tethered pair liquid feeder/toy set as in claim 1, wherein said means for receiving and making a tether line attachment on said general combination of said container and said nozzle ring is a small hole in said combination into which an end of said tether line may be inserted and sealed therein.

5. Tethered pair liquid feeder/toy set as in claim 1, wherein said means for receiving and making a tether line attachment on said general combination of said container and said nozzle ring is a boss with eyelet on said combination onto which an end of said tether line maybe fastened.

6. Tethered pair liquid feeder/toy set as in claim 1, wherein said containers are made of transparent material.

7. Tethered pair liquid feeder/toy set, normally for infant use, comprising a pair of generally spherical containers, constructed for holding liquids, with said containers linked together by a short tether line, and said containers having nozzle openings having means that readily and securely fitted with any of several of interchangeable feeder/toy fixtures including infant feeding nipples, closure caps for said containers and closure caps for said containers with attached toys.

8. Tethered pair liquid feeder/toy set as in claim 7, wherein said containers are made of transparent material.

9. Tethered pair liquid feeder/toy set, normally for infant use, comprising:

a pair of conventional elongated containers for infant feeding; two of any interchangeable feeders fixtures with flanges, including nipples, closure discs, and closure discs with toys attached;

a pair of rotatable threaded closure rings used to secure said interchangeable nipples and closure discs to openings at tops of said containers with said closure rings, with said rings having means for attachment of a tether line;

a length of tether line suitable for attachment to said attachment means on said closure rings;

whereby said pair of containers are connected by said tether line by attachment of ends of said line to said attachment means on said closure rings, with any of two of the said infant fixtures in place at tops of said containers, secured by said closure rings.

10. Tethered pair liquid feeder/toy set as in claim 9, wherein said means for attachment of said tether line is a boss with eyelet on each of said closure rings.

11. Tethered pair liquid feeder/toy set as in claim 9, wherein said attachment means for said tether line and said tether line itself comprise a pair of thin flat rings with sizes of diameters about same as the flange of said feeding nipples, made of pliable material, with tabs on inner sides of said flat rings, said tabs having attachment aperture therethrough to which said tether line is attached, whereby said flat rings can be folded and passed through openings of said closure rings and then placed on the flanges of any of said infant feeding fixtures and then finally secured on tops of said containers by placement and rotation of said closure rings.

12. Tethered pair liquid feed/toy set as in claim 11, wherein said tether line has beads strung thereon, whereby providing a medium for infant play and a safety precaution against any possible cutting effect of said tether line.

13. Tethered pair liquid feeder/toy set as in claim 9, wherein toy objects are placed in a least one of said containers.

14. Tethered pair liquid feeder/toy set, normally for infant use, comprising:

a pair of conventional elongated containers, constructed for holding liquid for infant feeding by use of nipples;

a pair of rotatable threaded closure rings used to secure said nipples to openings defined by necks at tops of said containers;

a length of tether line suitable for forming said paired tethered set, with each end of said tether line having a means of attachment to a unit comprised of one of said containers and one of said closure rings;

two of a number of interchangeable feeder/toy fixtures, including said infant feeding nipples, container closure discs and container closure discs with attached toys, with all of said fixtures having flanges and sizes suitable for attachment to and functional use on tops of said containers, being secured in place with said closure rings;

whereby a pair of units comprised of said containers and said closure rings, with any two of the said infant feeding/toy fixtures in place at tops of said containers secured by said closure rings, are connected by said attachment means at the two ends of the said tether line.

15. Tethered pair liquid feeder/toy set as in claim 14, wherein said means of said tether attachment is in the form of elastic loops on said tether line ends which are stretched and placed around the necks of said containers.

16. Tethered pair liquid feeder/toy set as in claim 14, wherein said attachment means for said tether line is in the form of a pair of thin flat rings with sizes of diamenters about same as the flanges of said nipples, made of pliable material, with each end of said tether line attached to one of said thin flat rings, whereby said flat rings can be folded slightly and passed through openings of said closure rings and then placed on flanges of any of said infant feeding fixtures and then finally secured on tops of said containers by placement and rotation of said closure rings.

* * * * *